US007329063B2

(12) United States Patent
Kato

(10) Patent No.: US 7,329,063 B2
(45) Date of Patent: Feb. 12, 2008

(54) TWIST-TYPE TELESCOPIC BALL-POINT PEN

(75) Inventor: Hiroyasu Kato, Takasaki (JP)

(73) Assignee: Katoh Kinzoku Kougyo Kabushiki Kaisha, Tomioka-shi (JP)

( * ) Notice: Subject to any disclaimer, the term of this patent is extended or adjusted under 35 U.S.C. 154(b) by 500 days.

(21) Appl. No.: 11/030,529

(22) Filed: Jan. 5, 2005

(65) Prior Publication Data

US 2005/0214057 A1 Sep. 29, 2005

(30) Foreign Application Priority Data

Mar. 24, 2004 (JP) ..... 2004-086457

(51) Int. Cl.
*B43K 5/16* (2006.01)
*A45D 40/02* (2006.01)

(52) U.S. Cl. ..... 401/116; 401/86

(58) Field of Classification Search ..... 401/85–94, 401/29, 32, 116
See application file for complete search history.

(56) References Cited

U.S. PATENT DOCUMENTS 3,597,100 A 8/1971 Ganz
4,601,599 A 7/1986 Katoh
5,547,301 A * 8/1996 Kageyama et al. ..... 401/116
6,474,889 B2 11/2002 Kato
6,517,271 B1 * 2/2003 Kageyama et al. ..... 401/92
7,018,124 B1 * 3/2006 Kageyama et al. ..... 401/258

FOREIGN PATENT DOCUMENTS

| | | |
|---|---|---|
| JP | 60-199698 | 10/1985 |
| JP | 60-199699 | 10/1985 |
| JP | 61-202894 | 9/1986 |
| JP | 2-21398 | 5/1990 |
| JP | 4-27670 | 7/1992 |
| JP | 6-27433 | 7/1994 |
| JP | 6-34156 | 9/1994 |
| JP | 7-32132 | 7/1995 |
| JP | 2509549 | 6/1996 |
| JP | 10-157383 | 6/1998 |
| JP | 2003-127587 | 5/2003 |

* cited by examiner

*Primary Examiner*—David J. Walczak
(74) *Attorney, Agent, or Firm*—Christensen O'Connor Johnson Kindness PLLC

(57) ABSTRACT

An extendable/contractible writing instrument with a simple rotating operation. The writing medium is exposed through a rotating motion, while at the same time also exposing an auxiliary tool, such as a silicon gum eraser, at the opposite end.

8 Claims, 6 Drawing Sheets

TWIST-TYPE TELESCOPIC BALL-POINT PEN

FIELD OF THE INVENTION

This invention is related to a twist-type extendable/contractible writing instrument that exposes a writing tip and another auxiliary tool from opposite ends of the writing instrument.

BACKGROUND OF THE INVENTION

The conventional extendable/contractible type ball point pens and mechanical pencils write through the exposure of the writing medium from the pointed end of a cap. An eraser, or the like, with which the writing is erased, is attached at the end opposite to the cap.

In such cases, the eraser is exposed through an operation entirely separate from that of the extension and contraction of the writing medium. An example is the removal of an eraser cap to expose an eraser. Removing the eraser cap is cumbersome, and there is a possibility that the eraser cap will be lost.

Also, when the conventional extendable/contractible ballpoint pens are taken out of use, a sliding aglet is pressed to retract the ends of a shaft so as to push the writing tip of the ballpoint refill into a concealed position. When in use, the sliding aglet is pressed so as to cause the ends of the shaft to expand lengthwise and push the writing tip of the ink refill to the exposed position.

The conventional extendable/contractible type ballpoint pens require a high degree of machining accuracy, and the cost of assembly is high due to the complexity of the moving parts. Accordingly, there is a need to provide a writing instrument that eliminates the aforementioned drawbacks and provides further advantages.

SUMMARY OF THE INVENTION

The invention provides a twist-type writing instrument with a writing tip that can be extended and retracted through a simple rotating operation. A screw-type mechanism allows for an advantageous machining process and a relatively simple assembly. The writing instrument of the invention also provides for the addition of an auxiliary tool, such as an eraser, or the like, attached to the end opposite to the writing tip, which can be extended in connection with the extension or retraction of the writing tip. The writing instrument can be an ink pen, such as a ball point pen, or a mechanical pencil.

A twist-type extendable/contractible writing instrument has a body with a cap at the tip that can be attached and removed, a sheath that can slide on a narrow posterior section of the body, and a revolving shaft which is located inside the body. The revolving shaft is fixed to the posterior portion of the sheath at the top of the writing instrument. The writing instrument further includes a lead chamber located in the revolving shaft, which is loaded with the writing medium, and an attached casing that is connected to a narrow posterior portion of the lead chamber. The twisting of the rotating shaft, which is done with the body and the sheath, is converted into the linear motion of the lead chamber and attached casing, thereby causing the writing medium to be extended and exposed from the tip of the writing instrument. The attached casing can also be moved in a linear direction to thereby extend and expose an auxiliary tool, such as a silicon eraser, from the opening in the top end cap. The twist-type extendable/contractible writing instrument according to the invention can stop the rotating shaft when the lead tip protrudes from the cap, and can also provide for adjusting the length of the lead tip of the mechanical pencil by pressing on the top, sheath, and casing attached to the lead chamber in an up and down motion.

The twist-type writing instrument of the invention has the advantage that the writing tip can be extended and retracted through a simple twisting operation, and the screw-type mechanism allows for an advantageous machining process and a relatively simple assembly. Additionally, the writing instrument of the invention eliminates the need to remove a cap, or the like, in order to use an the auxiliary tool, such as an eraser. Moreover, writing can be carried out efficiently without concern about loss of the eraser cap.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
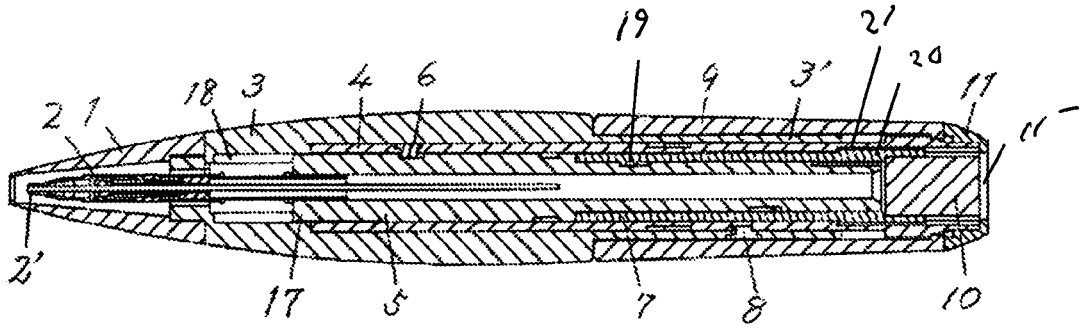
FIG. 1 is a front sectional illustration of a first embodiment of the twist-type extendable/contractible writing instrument when contracted.

The writing instrument in accordance with the invention includes a body 3 with a cap 1 at one end thereof that can be attached and detached; a sheath 9 that slides freely on a posterior narrow body section 3' of the body 3; a slotted rotating shaft 4 on the inside of the body 3 that is fixed to the posterior portion of sheath 9 through top cap 11; a slotted lead chamber 5 inside rotating shaft 4, which is loaded with a writing medium 2; and an attached casing 7 that is connected to a posterior narrow portion 5' of the lead chamber 5. By rotating or twisting the body 3 and sheath 9 to extend each from one another, a rotational movement is imparted to the rotating shaft 4, which is converted into the linear movement of the lead chamber 5 and the attached casing 7, such that a writing medium 2' protrudes from a hole in cap 1. At the same time and by further rotation and extension of the body 3 and sheath 9, the attached casing 7 moves in the direction of opening 11' of top end cap 11, and auxiliary tool 10, such as a silicon gum eraser, or the like, that is attached to the tip of casing 7, protrudes from opening 11' in the top end cap 11.

The linear motion of rotating shaft 4 is accomplished with a twist of the body 3 and sheath 9. Drive screw slot 12 is provided in the surface of rotating shaft 4. An axially oriented knocking slot 14 is connected to allowance slot 13, which is approximately perpendicular to the longitudinal axis of rotating shaft 4, and at the terminus of the drive screw slot 12. A bump 8 that protrudes from the inside of the narrow posterior body portion 3' slides freely within the drive screw slot 12, and is engaged by rotating body 3 and sheath 9.

The linear motion for casing 7, which is attached to lead chamber 5, is discussed below. The front half of lead chamber 5 contains allowance slot 15', which is perpendicular to the longitudinal axis of the extension screw slot 15 (having a pitch larger than the drive screw slot 12). Allowance slot 15' connects to and travels freely on the bump 6 that is fixed on rotating shaft 4. Narrow section 5' of the posterior half of lead chamber 5 includes extension screw slot 16 that extends out in the opposite direction. Extension screw slot 15 and extension screw slot 16 can be provided with the same pitch and the same rotational length. In addition, the tip portion of lead chamber 5 includes the thrust regulating protrusion 17, and connects to slot 18, which is located on the inside of the tip of body 3 allowing for only forward and backward movement, which provides for the linear motion of lead chamber 5. Moreover, the narrow auxiliary extension slot 16' with a pitch that is contiguous with the posterior portion of extension slot 16 is provided in a semicircle.

The motion of casing 7 is kinematically tied to both the motion of rotating shaft 4 and the motion of lead chamber 5. First, the rotation of casing 7 is tied to the rotation of rotating shaft 4 by the constraint provided by the interface of protrusion 20 of casing 7 with slot 21 of rotating shaft 4, which only allow relative longitudinal translation of casing 7 relative to rotating shaft 4. Second, the longitudinal position of casing 7 is tied to lead chamber 5 by the constraint provided by the interface of bump 19 of casing 7 with extension screw slot 16 and auxiliary extension slot 16' located on the narrow posterior portion 5' of lead chamber 5. In operation, because casing 7 is rotating with rotating shaft 4 and lead chamber 5 is not rotating relative to body 3, the relative rotation between casing 7 and lead chamber 5 produces relative translation between casing 7 and lead chamber 5 due to the interaction of bump 19 of casing 7 with extension screw slot 16 and auxiliary extension slot 16' of lead chamber 5.

A pencil lead is provided as the writing medium in the pointed tip portion of lead chamber 5. When body 3 and sheath 9 are extended in relation to each other, lead 2' of the writing medium 2 extends out from the pointed end of the cap 1, and the pencil is in ready-to-write condition. Pressing on sheath 9 at the top and wearing down the lead moves the bump S along knocking slot 14, As a consequence, lead chamber 5 moves forward, and the lead in mechanical pencil 2 extends out. Should the writing instrument be a ballpoint pen, knocking slot 14 would not be necessary.

Figure 2:
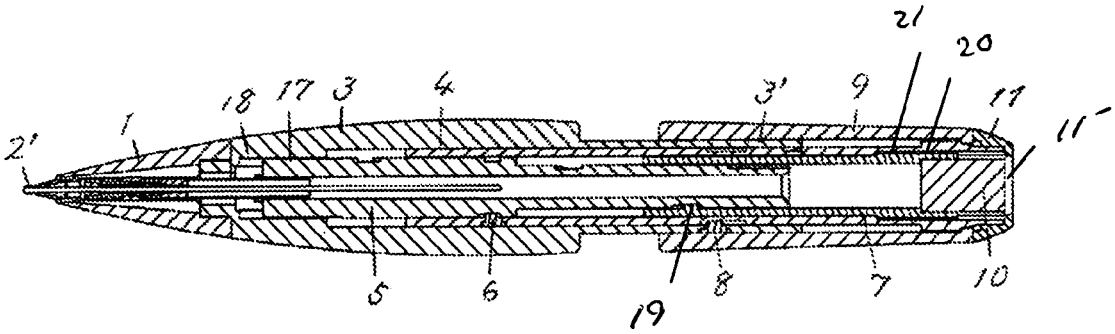
FIG. 2 is a front sectional illustration of the first embodiment of the twist-type extendable/contractible writing instrument when extended without the auxiliary tool protruding from the top end cap.
Figure 3:
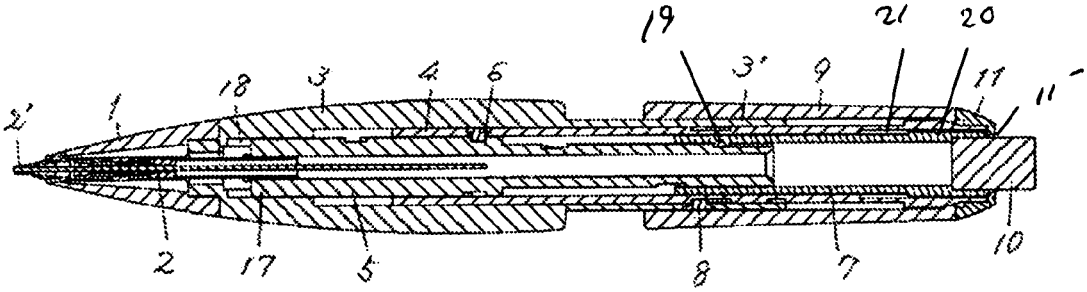
FIG. 3 is a front sectional illustration of the first embodiment of the twist-type extendable/contractible writing instrument when extended with the auxiliary tool protruding from the top end cap.
Figure 4:
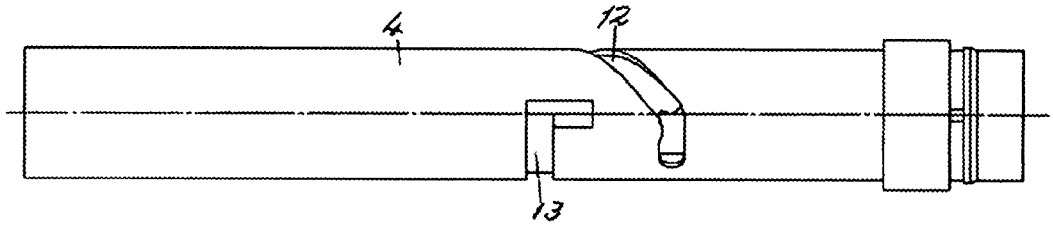
FIG. 4 is a bottom view illustration of the rotating shaft of the first embodiment in the orientation shown in FIG. 1.
Figure 5:
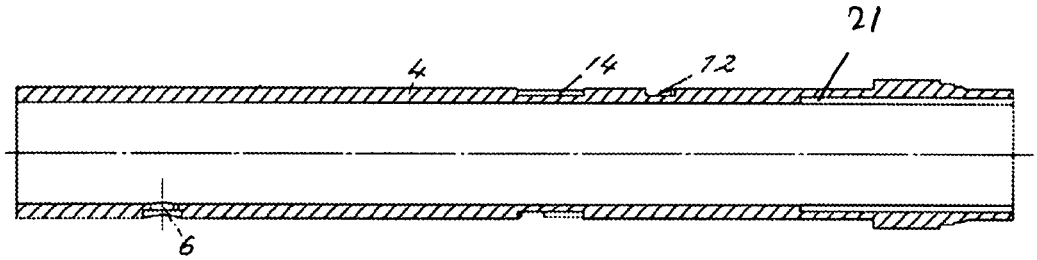
FIG. 5 is a front sectional illustration of the rotating shaft of the first embodiment in the orientation shown in FIG. 2.
Figure 6:
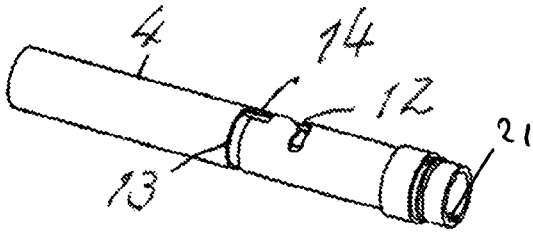
FIG. 6 is a perspective view illustration of the rotating shaft of the first embodiment shown in FIGS. 1-3.
Figure 7:
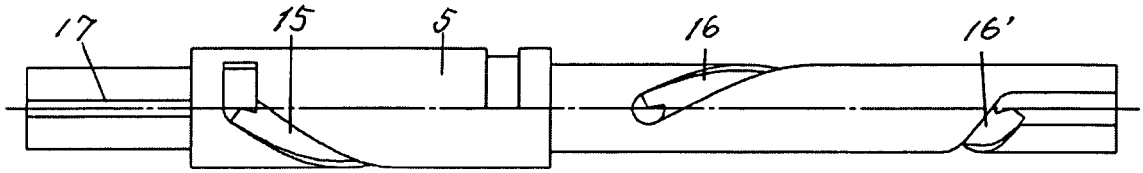
FIG. 7 is a top view illustration of the lead chamber of the first embodiment shown in FIGS. 1-3.
Figure 8:
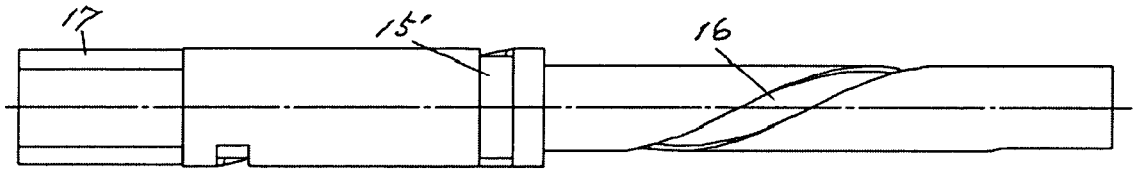
FIG. 8 is a rear view illustration of the lead chamber of the first embodiment shown in FIGS. 1-3.
Figure 9:
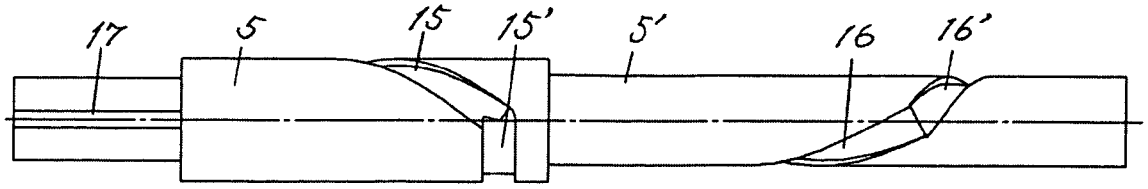
FIG. 9 is a bottom view illustration of the lead chamber of the first embodiment shown in FIGS. 1-3.
Figure 10:
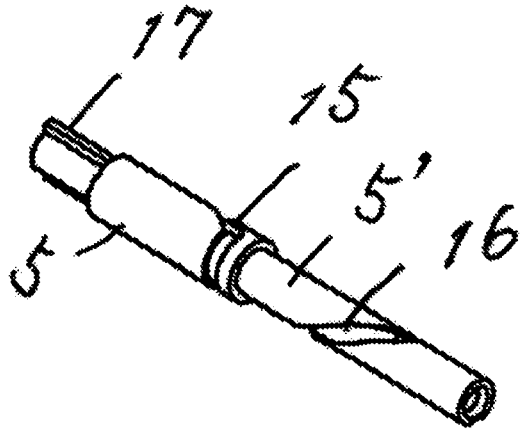
FIG. 10 is a perspective view illustration of the lead chamber of the first embodiment shown in FIGS. 1-3.

In some of the FIGS. 1 through 10, sheath 9 and body 3 are extended with about half the rotation (about 180 degrees) of sheath 9. In this state, the silicon gum eraser, as an auxiliary tool 10, is not extended, but writing with the writing instrument can be done. With repeated pushing on top cap 11 and sheath 9, the bump 8 moves along knocking slot 14, and the lead in mechanical pencil 2 is pushed out. Also, by turning sheath 9 about another half revolution in the same direction, only attached casing 7 moves in the posterior direction, and the auxiliary tool attached to the tip (silicon gum eraser in the FIGURES) is pushed out through the opening in top cap 11'.

Figure 11:
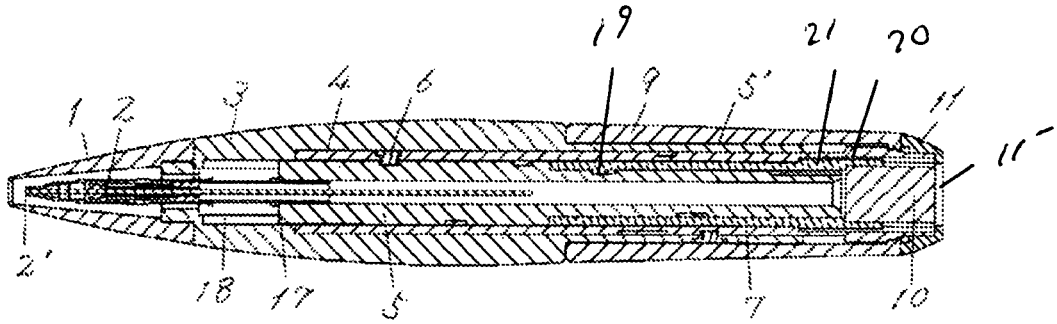
FIG. 11 is a front sectional illustration of a second embodiment of the twist-type extendable/contractible writing instrument when contracted.
Figure 12:
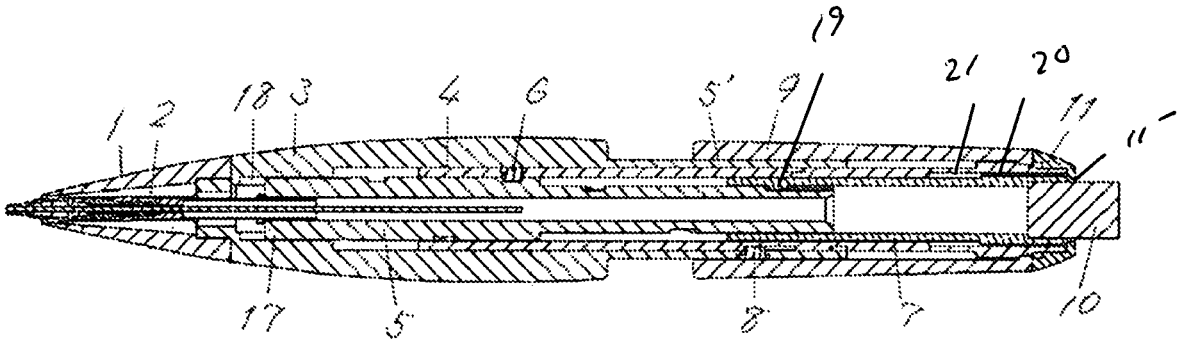
FIG. 12 is a front sectional illustration of the second embodiment of the twist-type extendable/contractible writing instrument when extended with the auxiliary tool protruding from the top end cap.
Figure 13:
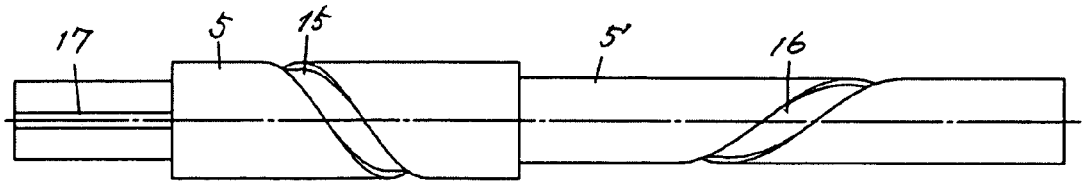
FIG. 13 is a bottom view illustration of the lead chamber of the second embodiment shown in FIGS. 11 and 12.
Figure 14:
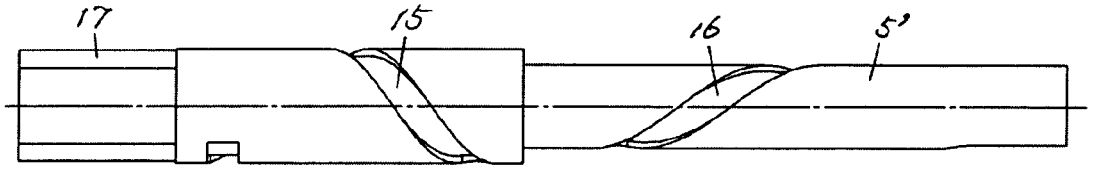
FIG. 14 is a rear view illustration of the lead chamber of the second embodiment shown in FIGS. 11 and 12.
Figure 15:
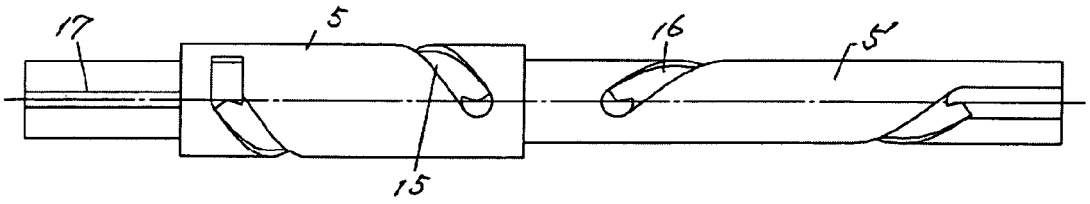
FIG. 15 is a top view illustration of the lead chamber of the second embodiment shown in FIGS. 11 and 12.
Figure 16:
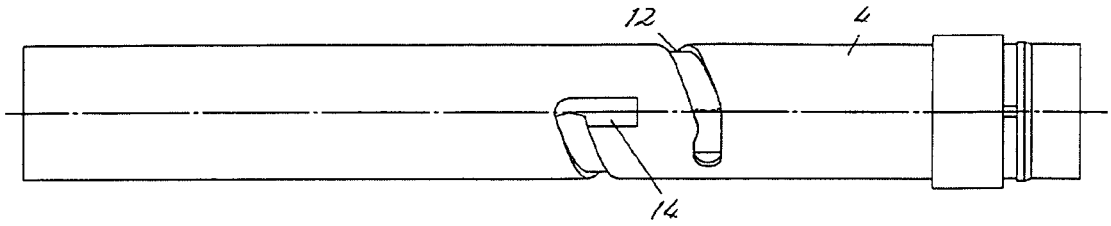
FIG. 16 is a bottom view illustration of the rotating shaft of the second embodiment in the orientation shown in FIG. 11.
Figure 17:
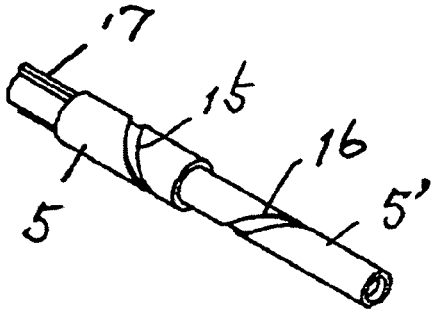
FIG. 17 is a perspective view illustration of the lead chamber of the second embodiment shown in FIGS. 11 and 12.

In FIGS. 11 through 17, sheath 9 and body 3 are extended with a single rotation (about 380 degrees) of sheath 9. In this state, the silicon gum eraser, as auxiliary tool 10, has been pushed out from top cap 11. Writing is done in this state through the repeated pressing of silicon gum 10, cap 11, and sheath 9, so that the bump 8 moves along knocking slot 14, and the pencil lead is pushed out.

As above, the pitch and length of drive screw slot 12, extension screw slot 15, and posterior section extension slot 16 are to be determined relative to the range of movement of writing medium 2 and attached casing 7.

In addition, although writing instrument 2 shows a mechanical pencil mechanism, a ballpoint pen would also be acceptable. Although auxiliary tool 10 shows a silicon gum eraser, the use of correcting fluid, different color writing medium, or other writing media, such as lipstick, chalk, etc., are possible.

The present invention includes a body 3, a rotating shaft 4, a lead chamber 5, and attached casing 7, all of which are cylindrical. Also, because these can be manufactured easily with a tapping machining process of the exterior surfaces, the manufacturing process permits an advantageous yield rate and simple assembly.

Also, because the lead tip writing instrument and silicon gum eraser auxiliary tool at both ends of the shaft can be extended out and used, there can be greater writing efficiency.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A twist-type extendable/contractible writing instrument, comprising:

(a) a body with a cap at the tip that can be attached and removed;

(b) a sheath that can slide on a narrow posterior section of the body;

(c) a rotating shaft fixed to the posterior portion of the sheath and located inside the body;

(d) a lead chamber located within the rotating shaft containing a writing medium; and (e) a casing that is engaged to a posterior portion of the lead chamber.

2. The writing instrument of claim 1, wherein the rotation of the rotating shaft, which is operated with the body and the sheath, is converted to the linear motion of the lead chamber and casing, and a writing medium can be extended out from the tip of the cap, wherein the attached casing can be moved in the direction of the opening in a top end cap, and an attached auxiliary tool, such as a silicon gum eraser, can be extended through the hole in the top end cap.

3. The twist-type extendable/contractible writing instrument of claim 1, wherein the rotation of the rotating shaft stops when the writing medium protrudes from the cap, and wherein:

the writing medium is a mechanical pencil lead, the sheath and casing are engaged to the lead chamber, and the length of the mechanical pencil lead can be adjusted by pressing the sheath and casing, toward the body and releasing.

4. A writing instrument, comprising:

(a) a body portion;

(b) a sheath portion slideably engaged to the body portion;

(c) a shaft portion fixed to the sheath portion, wherein the shaft portion includes a bump;

(d) a lead chamber supporting a writing medium having a first and second screw slot, wherein one screw slot is engaged with the bump on the shaft portion; and (e) a casing having a second bump, wherein the second bump is engaged with the second screw slot.

5. The writing instrument of claim 4, wherein the writing medium is a mechanical lead pencil or an ink pen.

6. The writing instrument of claim 4, wherein the first and second screw slots are of the same pitch and length.

7. The writing instrument of claim 4, wherein extending the sheath drives the lead chamber and casing in directions opposite to each other.

8. The writing instrument of claim 4, wherein the shaft includes a screw slot, the body includes a bump, and pressing the sheath causes extension of the lead chamber to expose a writing medium.

* * * * *

UNITED STATES PATENT AND TRADEMARK OFFICE

CERTIFICATE OF CORRECTION

PATENT NO. : 7,329,063 B2
APPLICATION NO. : 11/030529
DATED : February 12, 2008
INVENTOR(S) : H. Kato It is certified that error appears in the above-identified patent and that said Letters Patent is hereby corrected as shown below:

| COLUMN | LINE | |
|---|---|---|
| 5 (Claim 3, | 23 line 9) | after "and casing" delete "," |

Signed and Sealed this

Fourteenth Day of July, 2009

John Doll

JOHN DOLL
*Acting Director of the United States Patent and Trademark Office*